US010061271B2

(12) United States Patent
Lagorgette

(10) Patent No.: US 10,061,271 B2
(45) Date of Patent: Aug. 28, 2018

(54) ELECTROMECHANICAL TIMEPIECE MOVEMENT COMPRISING A DEVICE FOR DETECTION OF THE ANGULAR POSITION OF A WHEEL

(71) Applicant: ETA SA Manufacture Horlogere Suisse, Grenchen (CH)

(72) Inventor: Pascal Lagorgette, Bienne (CH)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 0 days.

(21) Appl. No.: 15/585,555

(22) Filed: May 3, 2017

(65) Prior Publication Data

US 2017/0322519 A1 Nov. 9, 2017

(30) Foreign Application Priority Data

May 4, 2016 (EP) ..... 16168244

(51) Int. Cl.
*G04C 3/14* (2006.01)

(52) U.S. Cl.
CPC ..... *G04C 3/143* (2013.01); *G04C 3/14* (2013.01)

(58) Field of Classification Search
CPC ..... G04C 3/146; G04C 3/143; G04C 3/14; G04C 17/0066; G04C 3/10; G04C 3/101
See application file for complete search history.

(56) References Cited

U.S. PATENT DOCUMENTS 2,632,993 A * 3/1953 Hill ..... G04B 1/20 368/209
4,415,272 A * 11/1983 Heinzelmann ..... G04B 27/005 368/185

(Continued)

FOREIGN PATENT DOCUMENTS

CH 640 098 12/1983
EP 0 720 073 A2 7/1996

(Continued)

OTHER PUBLICATIONS

European Search Report dated Oct. 13, 2016 in European Application 16168244.8, filed on May 4, 2016 (with English Translation of Categories of cited documents).

*Primary Examiner* — Sean Kayes
(74) *Attorney, Agent, or Firm* — Oblon, McClelland, Maier & Neustadt, L.L.P.

(57) ABSTRACT

The electromechanical timepiece movement comprises a stepping motor, a wheel driven in rotation by the motor, a pinion meshing with the wheel and a device for detecting the angular position of the wheel, the detection device making it possible to determine the passage of a reference half-axis of the wheel through a reference angle defined by the wheel and the pinion and comprising for such purpose an electronic circuit capable of detecting an additional localised resistive torque when the wheel is driven in a stepping motion. The localised resistive torque is achieved by a resilient element integral with the wheel and one portion of which is at least partially superposed on a given hollow of the toothing of said wheel. The movable component has a toothing which is at least partially situated at the level of the resilient element, such that the toothing moves and presses against the resilient element when it penetrates inside said given hollow.

6 Claims, 3 Drawing Sheets

(56) References Cited

U.S. PATENT DOCUMENTS

| | | | | |
|---|---|---|---|---|
| 5,751,664 | A | 5/1998 | Higuchi et al. | |
| 6,330,207 | B1 | 12/2001 | Born et al. | |
| 6,414,908 | B1 | 7/2002 | Kurasawa | |
| 2005/0185513 | A1* | 8/2005 | Tamura | G04C 3/146<br>368/28 |
| 2014/0070745 | A1* | 3/2014 | Hirono | H02P 27/06<br>318/400.32 |

FOREIGN PATENT DOCUMENTS

| | | | |
|---|---|---|---|
| EP | 0 952 426 | A1 | 10/1999 |
| WO | WO 2012/048557 | A1 | 4/2012 |

* cited by examiner

ELECTROMECHANICAL TIMEPIECE MOVEMENT COMPRISING A DEVICE FOR DETECTION OF THE ANGULAR POSITION OF A WHEEL

This application claims priority from European Patent Application No. 16168244.8 filed on May 4, 2016; the entire disclosure of which is incorporated herein by reference.

FIELD OF THE INVENTION

The present invention concerns an electromechanical timepiece movement comprising a stepping motor arranged to be capable of driving a gear train, comprising at least a first wheel and a pinion or a second wheel meshing with the first wheel, the timepiece movement further comprising a device for determining the angular position of the first wheel.

BACKGROUND OF THE INVENTION

Several devices for detecting the angular position of a wheel driven by a timepiece motor have been proposed. Several documents concern the arrangement of optical devices comprising a light source and a light sensor, wherein the timepiece movement is arranged to vary the reception of light by the sensor in a controlled manner as a function of the angular position of the wheel concerned. Other documents propose the arrangement of capacitive sensors or inductive sensors. Some documents propose the arrangement of magnetized elements and at least one Hall sensor. These devices are all relatively expensive and complex, Further, they often result in a relatively large overall dimension and/or require specific machining of parts of the timepiece movement, notably of the plate of the wheel concerned.

To decrease the cost, complexity and overall dimensions of the device for detecting the angular position of a wheel, it has been proposed to introduce a "hard point" in one gear of the gear train comprising the wheel concerned, such a "hard point" consisting in adding an additional load or respectively a resistive torque for the motor driving the gear train limited to a restricted angular area of the wheel. Detection of this additional resistive torque by suitable detection means, notably by determining the torque required to make one motor step, makes it possible to detect the passage of a reference axis of the wheel concerned through a certain reference angle relative to the axis of rotation of the wheel.

A first device without an additional external sensor is disclosed in CH Patent 640098, which provides for the arrangement of a ferromagnetic element on the wheel plate in proximity to the toothing and a fixed magnet at the periphery of the wheel. During the rotation of the wheel, when the ferromagnetic element approaches the magnet, the magnet attracts it in the direction of rotation and thus the energy required to make one motor step decreases. However, once the angular position of the magnet has been passed, the magnet exerts a force in the direction opposite to rotation, which causes an increase in the energy required to make one step. A circuit detecting the energy of the electrical pulse provided by the motor with each step makes it possible to determine the step in which the ferromagnetic element was substantially facing the magnet. This system has various drawbacks. Firstly, it uses a magnet, which may affect other elements of the timepiece movement. Further, the magnetic force on the wheel may have an axial component that generates a torque on the wheel arbor and increases friction in the bearings. Next, the arrangement of the magnet at the periphery of the wheel requires a certain space to be freed inside the movement, which is not always easy. Finally, the magnet acts on the ferromagnetic element over a relatively large angular distance corresponding to several motor steps. Detecting the position of the reference axis of the wheel, defined by the ferromagnetic element, therefore requires analysing the behaviour of the motor over several steps. It is therefore proposed here to analyse the current curve for each pulse and to determine the evolution of certain specific parameters of this curve which are dependent on the torque provided to make the corresponding step.

A second device without an additional external sensor is disclosed in U.S. Pat. No. 6,414,908. This document teaches the arrangement of a "hard point" producing a localised high load for the stepping motor on one or more steps when the wheel is being driven. The detection of this load is achieved in a given example by measuring the length of the motor pulses. More precisely, it is arranged here that normal pulses are supplied with a first energy to achieve the stepping motion of the gear train. A detection device can determine whether the rotor has properly completed a step once a normal pulse has been supplied. If this is not the case, it is arranged in this embodiment that a first correction pulse is supplied with a second energy, higher than the first energy. In normal operation, without a hard point arrangement, the driving of the gear train is ensured by the normal pulses and the first correction pulses. However, the resistive torque generated by the hard point arrangement requires a second correction pulse with a third energy, higher than the second energy. Thus, any detection of non-rotation, once a first correction pulse has been supplied, is caused by the hard point, which thus makes it possible to determine the position of a reference wheel axis simply by determining the steps that required a second correction pulse. By way of example, if a substantially constant electrical power is supplied to the motor, the various pulses are distinguished by their different respective lengths.

U.S. Pat. No. 6,414,908 describes in detail the detection of the passage of a hand through the "12 o'clock position", based on recording the steps that required a second correction pulse to be applied, but there is virtually no teaching as to the practical embodiment of a hard point. To produce an additional resistive torque, only two examples are briefly mentioned. The first variant proposes a local modification of the toothing profile. For the second variant, it is simply indicated that the additional resistive torque is generated by a cam. This second variant is vague and those skilled in the art are given virtually no practical teaching here. With regard to the first variant, it is not without interest, but no concrete example is given. It will be noted, however, that the implementation of this first variant poses certain technical problems. Firstly, making such a wheel with a non-uniform toothing complicates its manufacturing process. Next, given the manufacturing tolerances, it is not easy to ensure a hard point with a resistive torque whose value is within a given range. Finally, some gear play is generally necessary to ensure proper meshing. Creating a hard point by locally varying the toothing profile can easily result in impeding the rotation of the motor and thus the driving of the gear train associated with the motor.

SUMMARY OF THE INVENTION

It is an object of the present invention to provide an electromechanical timepiece movement with a device for detecting the angular position of a wheel which is relatively simple to produce and which can precisely detect the passage of a reference half-axis of the wheel through a given reference angle.

It is another object to provide such a detection device which operates without requiring complex processing of an electrical signal in connection with the electrical power supply of the stepping motor arranged to drive the wheel.

It is another object to provide a detection device of the aforementioned type which is relatively compact.

To this end, the electromechanical timepiece movement according to the invention includes a wheel driven in rotation by a stepping motor and a device for detecting the angular position of the wheel which is capable of detecting an additional resistive torque that momentarily occurs when the wheel is driven in steps. It is characterized in that said additional resistive torque is generated by a resilient element integral with the wheel and arranged to extend, in projection in a general plane of the wheel in which the toothing thereof is located, inside a hollow provided between two adjacent teeth of such toothing. Next, the timepiece movement is arranged such that the wheel meshes with a movable component having a toothing which is at least partially situated on the resilient element, such that the toothing moves and presses against the resilient element when one of its teeth penetrates said given hollow.

In an advantageous embodiment, the resilient element is configured to penetrate, in projection in the general plane of the wheel, to a lesser extent inside one and/or the other of the two hollows adjacent to the aforementioned given hollow or, preferably, not to penetrate inside said two adjacent hollows.

As a result of the features of the detection device of the invention, the additional resistive torque can be limited to the passage of one tooth of the movable component into a single given hollow of the wheel toothing. It is therefore very localised and can be detected, in some cases, within only one motor step. This simplifies processing of the electrical signal dependant on the torque supplied by the stepping motor associated with the wheel and makes it possible to determine an angular reference position of a reference half-axis of the wheel which passes through the centre of the given wheel toothing hollow and corresponds to a reference step of the motor.

According to an advantageous variant, the resilient element is a wire spring of small dimensions attached to the wheel plate. Such a wire spring is very compact and can easily be attached by various means of attachment, particularly by soldering, while ensuring that a portion of its free end is precisely arranged in superposition on the aforementioned given hollow.

BRIEF DESCRIPTION OF THE DRAWINGS

The invention will be described below with reference to the annexed drawings, given by way of non-limiting example, and in which.

DETAILED DESCRIPTION OF THE INVENTION

Figure 1:
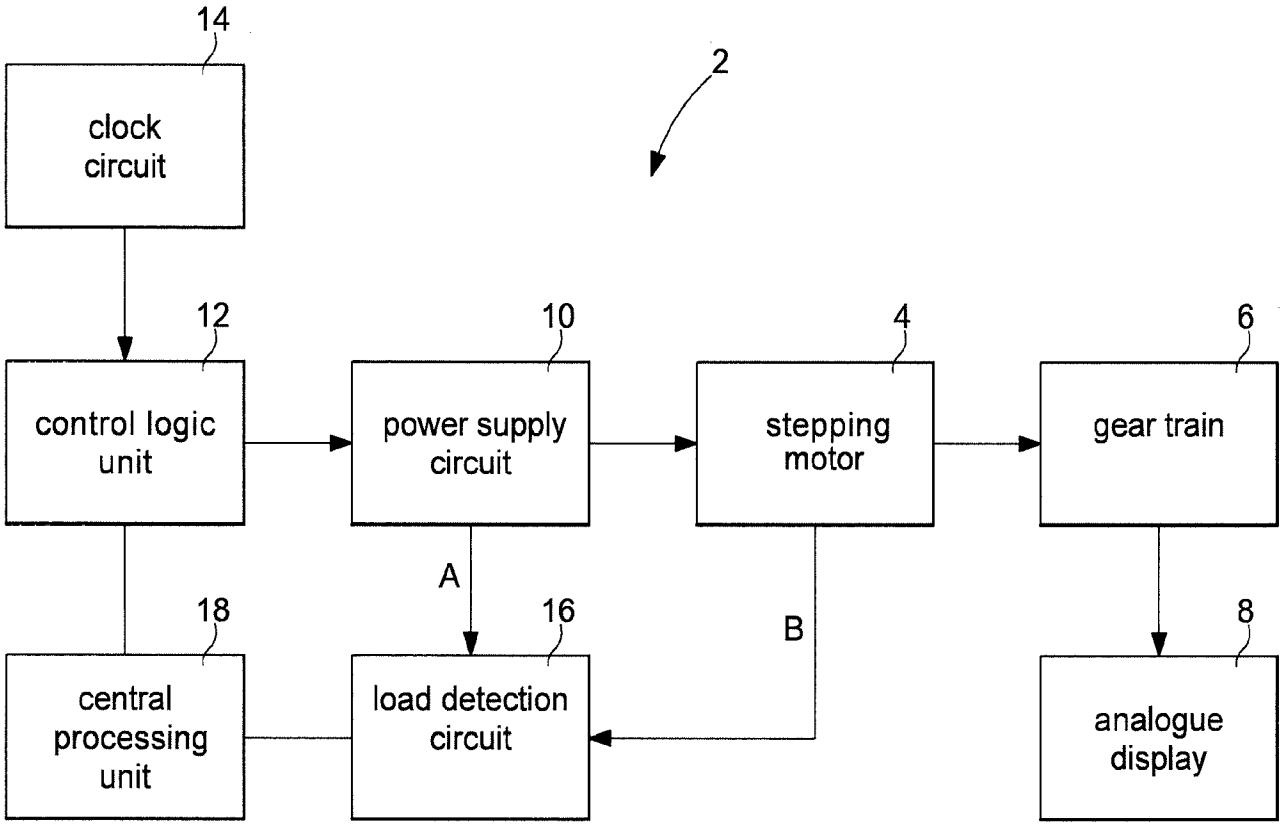
FIG. 1 is a block diagram of the electromechanical movement according to the invention.
Figure 2A:
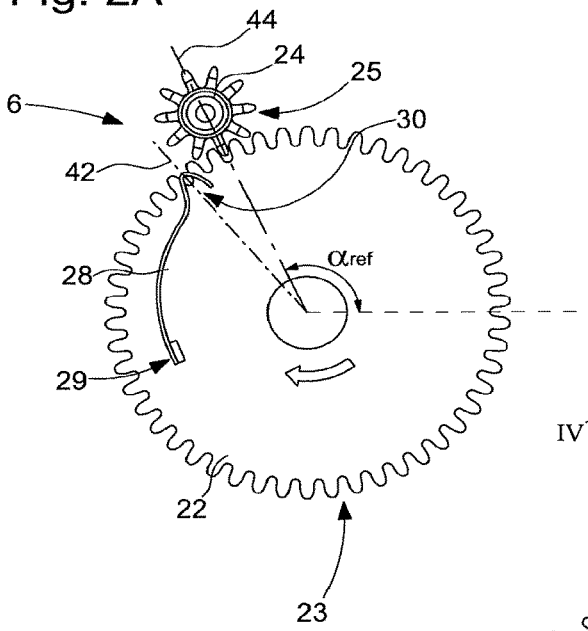
FIG. 2A is a top view of a wheel and a pinion of a gear train of the movement of FIG. 1, wherein the wheel is provided with a spring that belongs to the device for detecting the angular position of the wheel.
Figure 2B:
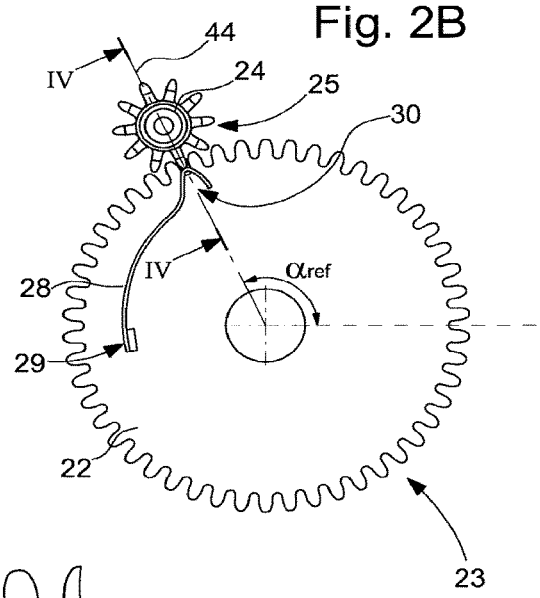
FIG. 2B is a similar view to that of FIG. 2A but with a particular angular position of the wheel in which an additional resistive toque is generated by the spring.

Referring to the Figures, there will be described below an embodiment of an electromechanical timepiece movement 2 comprising a stepping motor 4, a gear train 6 coupled to the motor and driving an analogue display 8. In a conventional manner, the movement also includes a power supply circuit 10 for the motor, a control logic circuit 12 which provides the power supply circuit with signals for shaping pulses applied to the motor, a clock circuit 14 defining a time base, particularly for logic circuit 12, and a central processing unit 18, which manages the various functions of the timepiece movement. Finally, the timepiece movement also includes a circuit 16 for detection of the load defined by the gear train and the analogue display, respectively of the motor torque supplied with each step to drive said load. This detection circuit forms part of a device for detecting the angular position of a wheel according to the invention. It is connected to the power supply circuit (connection A) and/or directly to the stepping motor (connection B) and/or also to the control logic circuit (in particular via the central processing unit).

Detection circuit 16 may be arranged in various ways known to those skilled in the art, in particular as in the aforementioned prior art. In the case where it is arranged that three different pulses can be provided with three different respective energies, load detection then consists in determining which of these three different pulses is required to effect a particular step. In another case, which provides real time management of the pulses as a function of load, load detection may occur in various ways, by analysing one or more parameters of the three physical parameters involved in the energy of an electrical pulse, i.e. time, the voltage applied and the current supplied. Load detection may be linked to a value of these parameters, for example the pulse length, peak current, or selected voltage, if applicable. In more sophisticated detection modes, it is possible to use several or these values or information derived therefrom. Finally, those skilled in the art also know detection means that analyse an induced voltage/an induced current in a motor coil after an electrical pulse has been supplied (using a switch between the power supply circuit and the detection circuit). Such an induced signal can, in particular, determine whether the step was properly taken, but an analysis of the signal can also provide information as to the resistive torque applied to the motor.

Figure 3:
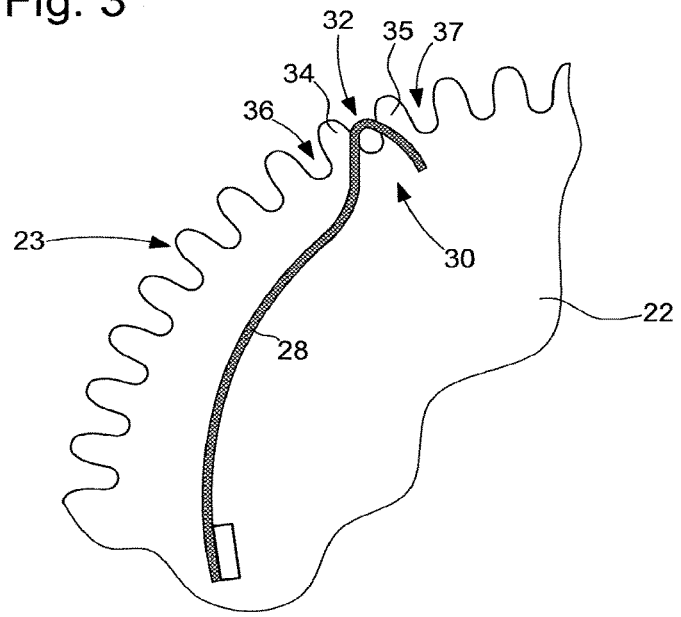
FIG. 3 is a partial enlargement of FIG. 2A.
Figure 4:
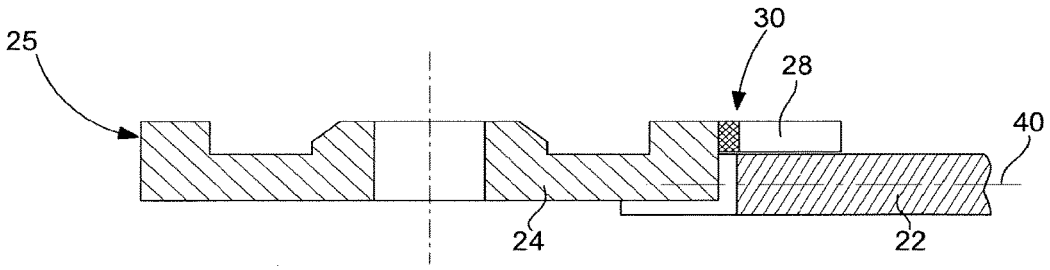
FIG. 4 is a partial cross-section along the line IV-IV of FIG. 2B.

Gear train 6 includes a wheel 22 having a toothing 23 and driven in rotation by the motor, and a pinion 24 having a toothing 25 and meshing with the wheel. This pinion forms, in a non-limiting manner, a movable component meshing with toothing 23 of wheel 22. An additional localised resistive torque is achieved by a resilient element 26 integral with wheel 22. This resilient element is formed by a wire spring which is arranged on the wheel plate and whose end 29 is attached to the plate. At a free end of the wire spring there is a bent portion 30, which is superposed on a given hollow 32 of toothing 23 between two adjacent teeth 34 and 35 of the toothing. It will be noted that, in the advantageous variant represented in the Figures, bent portion 30 is curved so that it is not superposed on the two hollows 36 and 37 which are adjacent to hollow 32. In another variant, the wire spring is attached at both ends, the bent portion being located approximately midway along the length of the wire spring. The bent portion advantageously protrudes from the main curvature of the wire spring, to be superposed on toothing 23 in a very localised manner. However, this advantageous variant is not limiting, since the resilient element does not necessarily have such a bent portion. Thus, for example, in a variant, only the tip of the free end of the spring is superposed on the wheel toothing. Finally, toothing 25 of pinion 24 is at least partially on the wire spring, as represented in the cross-sectional view of FIG. 3, so that the toothing presses against the resilient element, i.e. against the bent portion of the wire spring here, when it penetrates inside given hollow 32.

More generally, it is arranged that the resilient element is arranged to extend, in projection in a general plane 40 of wheel 22 in which its toothing 23 is located, into a given hollow; this resilient element is elastically deformable in a radial direction of the wheel substantially as far as the bottom of the given hollow (i.e. at least sufficiently to allow the pinion toothing to penetrate the hollow, without risk of blocking the meshing of the pinion with the wheel). Advantageously, the resilient element is configured to penetrate, in projection into said general plane, to a lesser extent inside one and/or the other of the two hollows adjacent to the given hollow than into said given hollow. Preferably, as in the variant set out above, it is arranged that the resilient element is made and attached to the wheel so that it does not penetrate, in projection into said general plane, inside the two adjacent hollows.

The device for detecting the angular position of wheel 22 can thus determine the passage of a reference half-axis 42 of the wheel through a reference direction 44, corresponding to a reference angle $\alpha_{REF}$, defined by said wheel and the movable component. Half-axis 42 is defined by the middle of hollow 32, respectively by the portion of bent part 30 of the wire spring which is superposed on said selected hollow. Reference angle $\alpha_{REF}$, corresponds, in the case of a movable component forming a wheel or a pinion, to the angular position of a straight line 44 passing through the centre of wheel 22 and the centre of said movable component. The detection device according to the invention thus comprises a 'hard point' located in only one hollow of the wheel toothing, and for said detection, it includes an electronic circuit capable of detecting an additional resistive torque that occurs momentarily when wheel 22 and pinion 24 are driven in a stepping motion by motor 4.

Figure 5A:
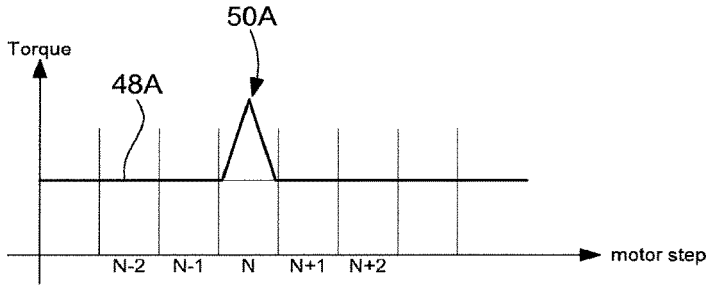
FIGS. 5A to 5C are schematic views of the torque curves provided by the stepping motor for three different variants.
Figure 5B:
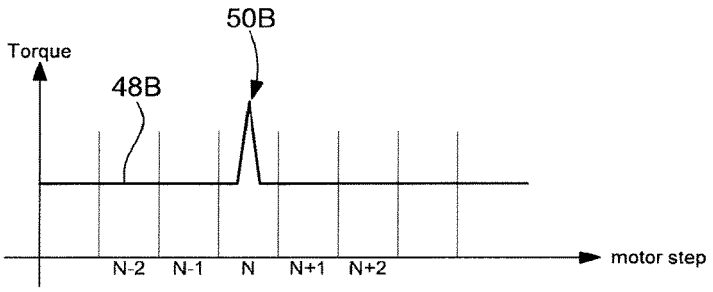
Figure 5C:
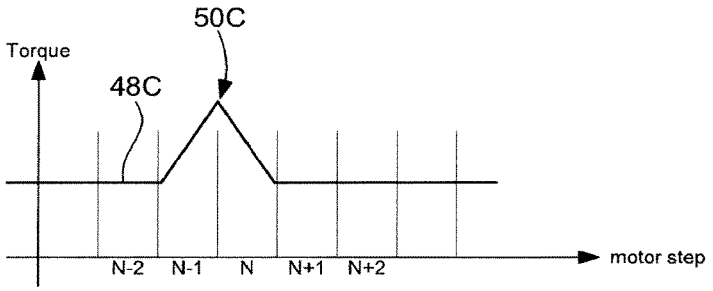

FIGS. 5A, 5B and 5C respectively represent three curves 48A, 48B and 48C indicating the torque provided by the motor when gear train 6 is driven in a stepping motion, with the passage of one tooth of pinion 24 into hollow 32 of the toothing of wheel 22 and thus through the hard point generated by wire spring 28, which is superposed only on this given hollow. These three curves are a schematic representation of the resistive torque that the motor has to overcome during a series of pulses which are represented as joined, whereas in normal operation the pulses are separated by rest periods of the stepping motor.

FIG. 5A corresponds to a particular situation for a toothing 23 with sixty teeth and a wheel effecting sixty steps per revolution. In this case, the additional resistive torque generated by the wire spring occurs for only one motor step, such that the angular position of the wheel is determined immediately upon the detection, for a step N, of a peak 50A in the torque supplied by the motor. It will be noted however, that it is also possible, depending on the relative position of the toothings that mesh during the motor rest periods, for the effect of the additional resistive torque to be felt over two consecutive steps. This is notably the case if a motor rest position corresponds to a situation where bent portion 30 is pressed by a tooth of toothing 25. In that case, it is therefore necessary to define which of the two consecutive steps is the one that defines the angular reference position.

FIG. 5B corresponds to a variant wherein toothing 23 also has sixty teeth, but the wheel completes one revolution every thirty steps. The resistive torque increase peak 50B occurs over a shorter duration than a standard pulse length. As there is generally no practical advantage in knowing a reference position with a precision greater than that defined by one motor step, it will be noted that bent portion 30 of the wire spring could, in another variant, extend over two consecutive hollows, in particular if, advantageously, the meshing relationship of the two toothings is precisely controlled so that the two consecutive hollows are penetrated in the same step. However, preferably, a variant embodiment will be retained with the wire spring superposed on only one hollow. Thus, the relative position of the toothings during motor rest periods is less critical. The motor and the gear trains will preferably be mounted so that the passage of given hollow 32 occurs during only one step made by the motor.

FIG. 5C corresponds to a variant wherein toothing 23 has thirty teeth and the wheel makes sixty steps per revolution. In this case, the additional resistive torque is felt over several consecutive steps, with torque peak 50C extending over at least two steps and generally over three steps. Analysing the power supply signal generating the electrical pulses concerned by the several consecutive steps generally makes it possible to define the step in which the reistive torque passes through a maximum and therefore to determine the step corresponding to the reference position of wheel 22. However, in the case where the additional resistive torque acts over several consecutive steps of the motor, there are several ways to define which is the reference step. For example, it can be arranged to be the first step with a resistive torque above a predetermined threshold, or the last step of a series of steps which all have a resistive torque above said threshold. It is understood that it is also possible to choose a step situated in the middle of such a series of steps, or the step that follows such a series, i.e. the first step with a torque lower than a given threshold after a series of steps in which the resistive torque was above the threshold.

The detection device according to the invention is compact. It has the advantage, in terms of construction, that the entire detection device (with the exception of the electronic part which is incorporated in the electronic circuit of the timepiece movement) is placed on the wheel concerned. Indeed, all that is required is one resilient element integral with the wheel in question. It can easily be attached to the wheel so that it covers only one hollow.

What is claimed is:

1. An electromechanical timepiece movement comprising a stepping motor, a wheel driven in rotation by said motor, a movable component meshing with said wheel and a device for detecting an angular position of the wheel, said detection device making it possible to determine a passage of a reference half-axis of said wheel through a reference angle defined by said wheel and the movable component and comprising for such purpose an electronic circuit capable of detecting an additional resistive torque that occurs momentarily when the wheel and movable component are driven in a stepping motion by the motor; wherein said additional resistive torque is generated by a resilient element integral with the wheel and arranged to extend, in projection into a general plane of said wheel in which toothing thereof is located, at least inside one given hollow between two adjacent teeth of said toothing, said resilient element being elastically deformable in a radial direction of the wheel substantially as far as a bottom of said given hollow; and wherein said movable component has the toothing which is at least partially situated at a level of said resilient element, such that said toothing moves and presses against the resilient element when said toothing penetrates said given hollow.

2. The electromechanical timepiece movement according to claim 1, wherein said resilient element is configured to penetrate, in projection in said general plane, inside one and/or an other of two hollows adjacent to said given hollow to a lesser extent than inside said given hollow, or not to penetrate inside said two adjacent hollows.

3. The electromechanical timepiece movement according to claim 1, wherein the resilient element is arranged on a plate of said wheel, which contains said wheel toothing on the periphery thereof, said resilient element having a portion superposed on said given hollow of said toothing.

4. The electromechanical timepiece movement according to claim 3, wherein the resilient element is formed by a wire spring attached to the wheel at at least one of two ends thereof.

5. The electromechanical timepiece movement according to claim 4, wherein the wire spring has a bent portion protruding from a main curvature thereof, said bent portion being superposed on said given hollow of said toothing of said wheel.

6. The electromechanical timepiece movement according to claim 1, wherein said movable component is a pinion or another wheel forming with said wheel a gear train of the timepiece movement.

* * * * *